US007990805B2

(12) United States Patent
Kumhyr et al.

(10) Patent No.: US 7,990,805 B2
(45) Date of Patent: Aug. 2, 2011

(54) SYSTEM AND METHOD FOR IMPLEMENTING NON-LETHAL CHEMICAL WARFARE AGAINST RAMPAGE SHOOTERS

(75) Inventors: David B. Kumhyr, Austin, TX (US); Ori Pomerantz, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 956 days.

(21) Appl. No.: 11/875,454

(22) Filed: Oct. 19, 2007

(65) Prior Publication Data

US 2010/0264217 A1 Oct. 21, 2010

(51) Int. Cl.
*G06G 7/80* (2006.01)

(52) U.S. Cl. ..... 367/136; 367/906

(58) Field of Classification Search ..... 367/136, 367/906

See application file for complete search history.

(56) References Cited

U.S. PATENT DOCUMENTS

| | | | | |
|---|---|---|---|---|
| 6,552,963 | B2 | 4/2003 | Baranek et al. | |
| 6,558,705 | B2 | 5/2003 | O'Brien | |
| 6,847,587 | B2 | 1/2005 | Patterson et al. | |
| 2003/0098795 | A1 | 5/2003 | Marcos | |
| 2006/0109113 | A1 | 5/2006 | Reyes et al. | |
| 2007/0007384 | A1 | 1/2007 | Sliwa | |
| 2010/0264217 | A1 * | 10/2010 | Kumhyr et al. | 235/400 |

* cited by examiner

*Primary Examiner* — Dan Pihulic
(74) *Attorney, Agent, or Firm* — Dillon & Yudell LLP

(57) ABSTRACT

A system and method for implementing non-lethal chemical warfare against rampage shooters. A sound detection module detects a sound of a gunshot from at least one of a collection of sensors within a building. A sound location module determines a location of the gunshot by analyzing the sound. At least one emitter releases non-lethal chemical countermeasures from at least one at the location of the gunshot.

6 Claims, 3 Drawing Sheets

SYSTEM AND METHOD FOR IMPLEMENTING NON-LETHAL CHEMICAL WARFARE AGAINST RAMPAGE SHOOTERS

BACKGROUND OF THE INVENTION

1. Technical Field

The present invention relates in general to the field of security systems and in particular, to the field of computer-controlled security systems.

2. Description of the Related Art

Those with skill in the art will appreciate that security systems have become increasingly automated with the advent of low-cost, yet powerful computer systems. The integration of computers and other media devices such as video cameras and microphones enable a remote security company to respond to threats as they occur, instead of waiting for the owner or manager of the premises to report a disturbance via telephone.

SUMMARY OF THE INVENTION

The present invention includes a system and method for implementing non-lethal chemical warfare against rampage shooters. A sound detection module detects a sound of a gunshot from at least one of a collection of sensors within a building. A sound location module determines a location of the gunshot by analyzing the sound. At least one emitter releases non-lethal chemical countermeasures from at least one location.

The above, as well as additional objectives, features, and advantages of the present invention, will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF AN EMBODIMENT

Figure 1:
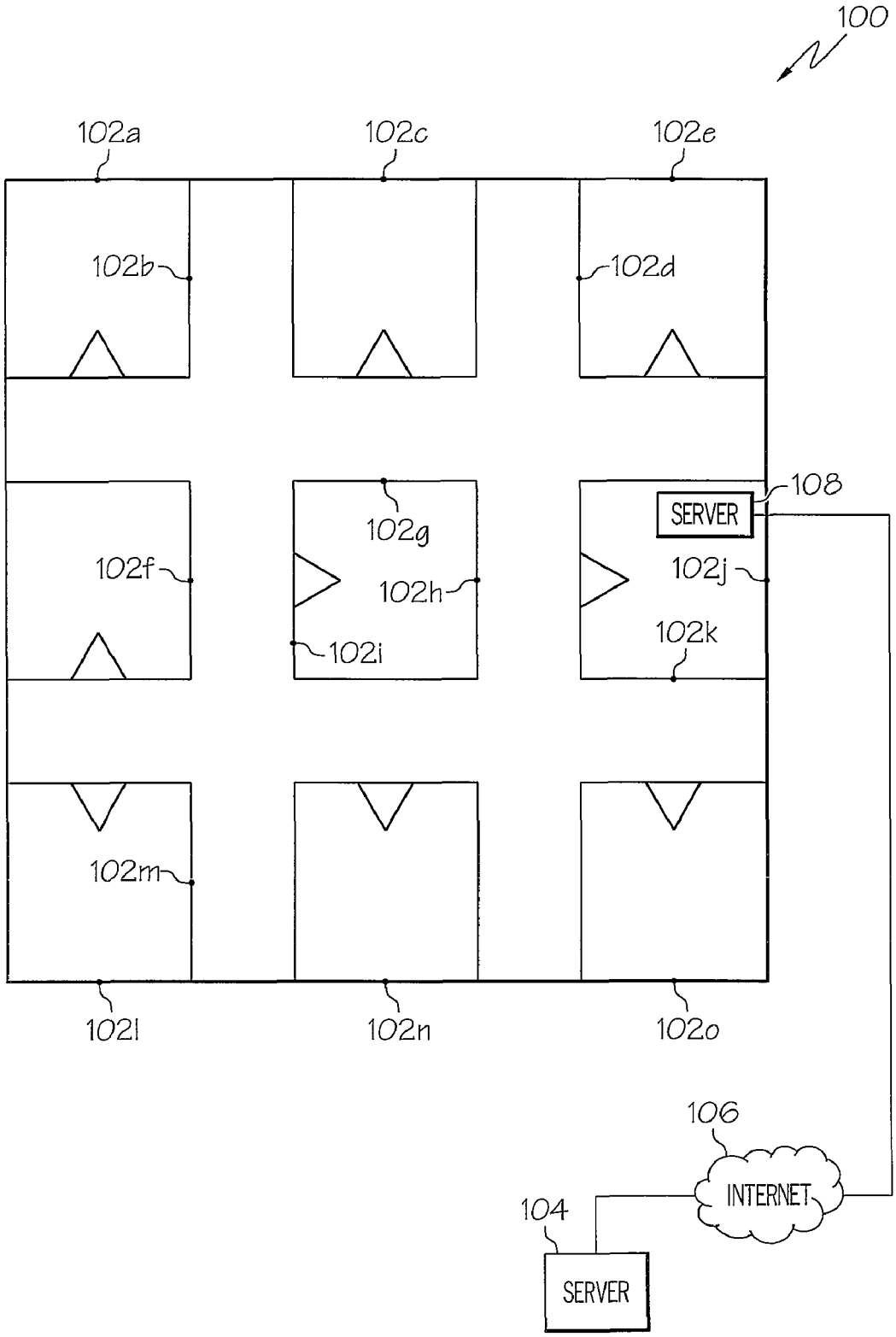
FIG. 1 is a pictorial representation of an exemplary network installed in a multi-room floor according to an embodiment of the present invention.

Referring now to the figures, and in particular, referring to FIG. 1, there is illustrated an exemplary network 100 in which an embodiment of the present invention may be implemented. As depicted, exemplary network 100 includes: sensors/emitters 102*a*-102*o*, servers 104 and 108, and Internet 106. All of exemplary network 100, except for Internet 106 and server 104, is located within a multi-room building. While FIG. 1 illustrates a one-story building that includes nine rooms, those with skill in the art will appreciate that the present invention is not limited to the depicted configuration, but may be extended to any building configuration with any number of rooms, any number of hallways, and any number of sensor/emitters. Also, those with skill in the art will appreciate that the sensor/emitters may be implemented as a combined unit or separate units.

Servers 104 and 108 may be implemented as any type of server or data processing system that enables the sending, receipt, and processing of data to and from sensors/emitters 102*a*-102*o*. While Internet 106 is utilized to couple servers 104 and 108, those with skill in the art will appreciate that a local-area network (LAN) or a wide-area network (WAN) utilizing Ethernet, IEEE 802.11x, or any other communications protocol may be utilized.

Also, sensors/emitters 102*a*-102*o* are coupled to server 108 via any type of wired or wireless connection. According to an embodiment of the present invention, sensors/emitters 102*a*-102*o* may be implemented by audio sensors that send information on detected sounds to server 104. If server 108 determines that a detected sound is the sound of a gunshot, server 108 can determine the location of the detected gunshot and utilize triangulation or any other method to pinpoint a possible location of the gunshot. Once server 104 has pinpointed the possible location of the gunshot, server 108 sends a signal to the closest sensors/emitters 102*a*-102*o* to the pinpointed location instructing the selected sensors/emitters 102*a*-102*o* to emit a non-lethal incapacitating agent (e.g., a tear gas, pepper spray, other types of chemical agents or some other non-lethal force) to prevent the shooter from targeting any other bystanders. The chemical agent causes the shooter and any potential victims to shut their eyes, sneeze, etc. In an embodiment of the present invention, sensors/emitters 102*a*-102*n* may utilize a nozzle-less system to reduce the chance of theft. Also, an embodiment of the present invention may enable authorities to identify people who are in the vicinity of the pinpointed location of the gunshot. The identified persons may be later questioned and utilized as eye witnesses.

While the physiological effects are identical, the disruption of the behavior is not. Potential victims can still run while sneezing, and at least crawl forward while their eyes are shut. Shooters, however, are unable to aim their guns, thus rendering them less likely to hurt others. Those with skill in the art will appreciate that sensors/emitters 102*a*-102*o* may utilize other methods to distract any shooters including, but not limited to: strobe lights, sirens, etc. After the initial gunshot detection, server 108 notifies a security team (located at server 104) via Internet 106 in order to reduce the necessary time needed for police response. Those with skill in the art will appreciate that exemplary network 100 may include other components such as routers, firewalls, etc. that are not germane to the discussion of exemplary network 100 and the present invention, and therefore will not be discussed further herein.

Figure 2:
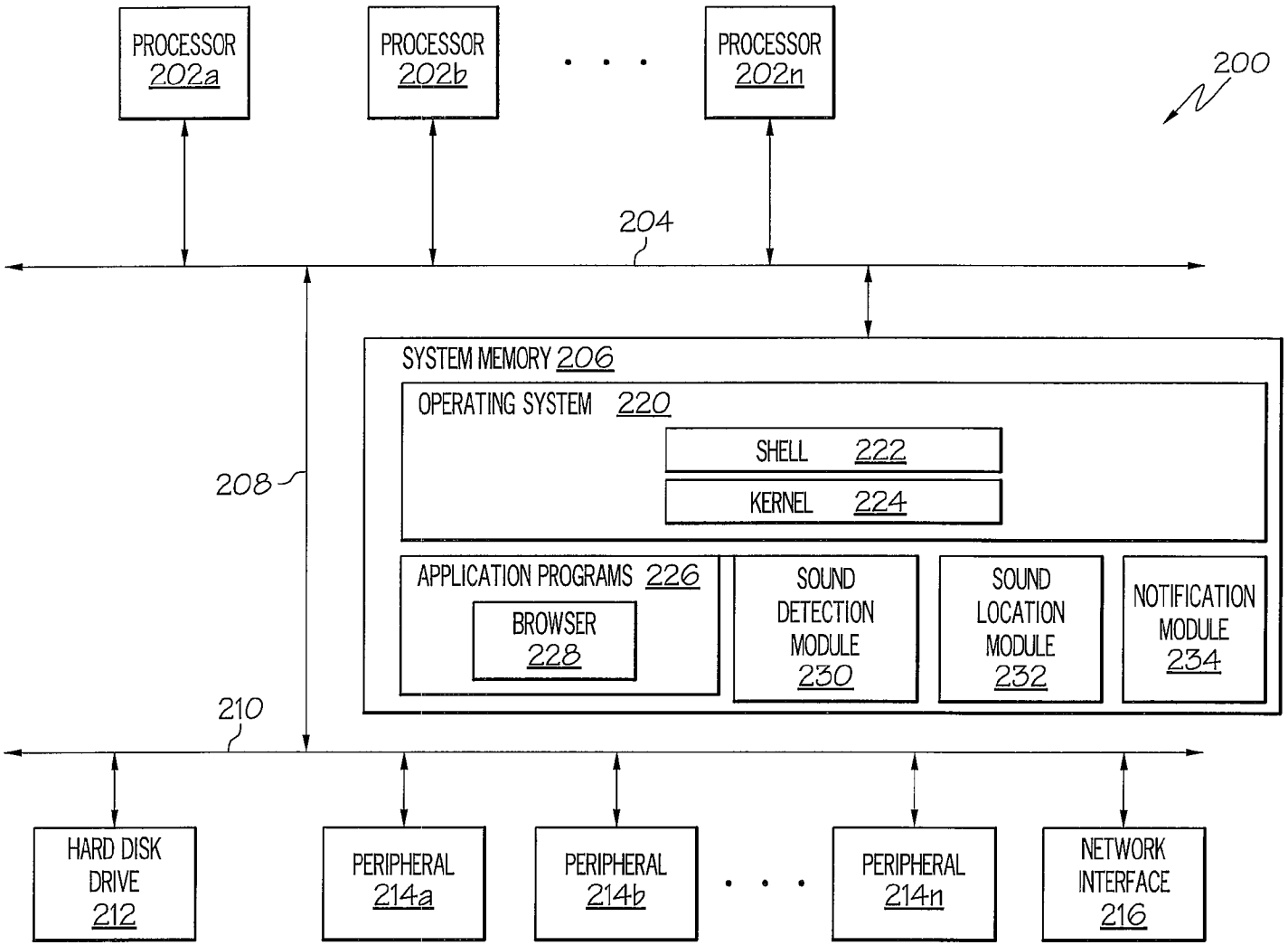
FIG. 2 depicts an exemplary data processing system in which an embodiment of the present invention may be implemented.

FIG. 2 is a block diagram depicting an exemplary data processing system 200, which may be utilized to implement servers 104 and 108 as shown in FIG. 1. As illustrated, exemplary data processing system 200 includes a collection of processors 202*a*-202*n* that is coupled to a system memory 206 via a system bus 204. System memory 206 may be implemented by dynamic random access memory (DRAM) modules or any other type of random access memory (RAM) module. Mezzanine bus 208 couples system bus 204 to peripheral bus 210. Coupled to peripheral bus 210 is a hard disk drive 212 for mass storage and a collection of peripherals 214*a*-214*n*, which may include, but are not limited to, optical drives, other hard disk drives, printers, and input devices, and the like. Network interface 216 enables data processing system 200 to communicate on a network, such as, but not limited to Internet 56.

Included in system memory 206 is operating system 220, which further includes a shell 222 (as it is called in the UNIX® operating system. UNIX® is a registered trademark of The Open Group in the United States and other countries), for providing transparent user access to resources such as application programs 226. Generally, shell 222, also called a command processor in Microsoft® Windows® operating system, is generally the highest level of the operating system software hierarchy ad serves as a command interpreter. Microsoft® and Windows® are trademarks of Microsoft Corporation in the United States, other countries, or both. Shell 222 provides a system prompt, interprets commands entered by keyboard, mouse, or other input media, and sends the interpreted command(s) to the appropriate lower levels of the operating system (e.g., kernel 224) for processing. Note that while shell 222 is a text-based, line-oriented user interface, the present invention will support other user interface modes, such as graphical, voice, gestural, etc. equally well.

As illustrated, operating system 220 also includes kernel 224 which includes lower levels of functionality for operating system 220 and application programs 226, including memory management, process and task management, disk management, and mouse and keyboard management. Application programs 226 can include browser 228, utilized for access to Internet 106 (FIG. 1), word processors, spreadsheets, and other application programs. Also, as depicted, system memory 206 includes sound detection module 230, sound location module 232, and notification module 234.

Figure 3:
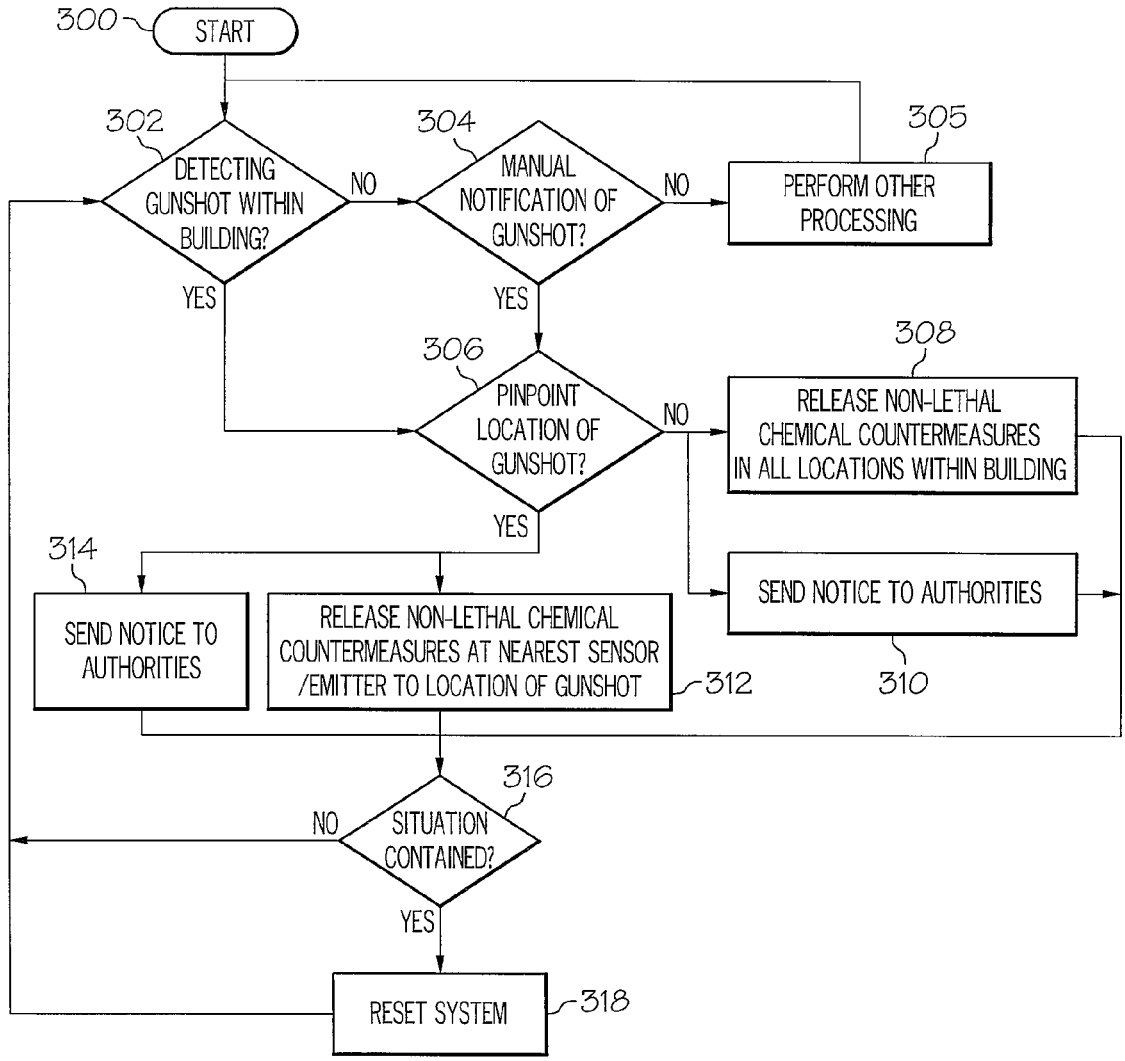
FIG. 3 is a high-level logical flowchart diagram illustrating an exemplary method for implementing non-lethal chemical warfare against rampage shooters according to an embodiment of the present invention.

As discussed herein in more detail in conjunction with FIG. 3, sound detection module 230 examines sounds sent by sensors/emitters 102*a*-102*o* for the sound of a gunshot. Those with skill in the art will appreciate that any type of sound recognition or sound matching software and/or hardware may be implemented to identify sounds of gunshots. Sound location module 232 analyzes the sounds sent by sensors/emitters 102*a*-102*o* to determine the location of the gunshot. Those with skill in the art will appreciate that any type of triangulation software and/or hardware or any other location method may be utilized to perform the location of the gunshot. Notification module 234 enables server 108 to notify authorities upon the detection of a gunshot, which reduces police/security response time.

FIG. 3 is a high-level logical flowchart illustrating an exemplary method for implementing non-lethal chemical warfare against rampage shooters according to an embodiment of the present invention. The process begins at step 300 and proceeds to step 302, which illustrates sound detection module 230 (FIG. 2) in server 108 (FIG. 1) determining if the sound of a gunshot within the building has been detected by at least one of sensors/emitters 102*a*-102*o* (FIG. 1).

The process continues to step 304, which depicts server 108 determining if a manual notification of a gunshot has been received. The manual notification may come in various forms including, but not limited to a message received by notification module 234 from server 104 via Internet 106 or a person manually activating an alarm inside or outside the building. If there is no manual notification of a gunshot, the process proceeds to step 305, which shows network 100 performing other processing. The process returns to step 302.

Returning to step 304, if sever 108 has received manual notification of a gunshot, the process continues to step 306, which illustrates server 108 determining if any information has been received that indicates the location of the gunshot. According to an embodiment of the present invention, information regarding the location of the gunshot includes, but is not limited to, reports from witnesses, location of the manually-activated alarm, etc. If the location of the gunshot is known, the process proceeds to steps 312 and 314. If not, the process continues to steps 308 and 310.

Returning to step 302, if sound detection module 230 detects the sound of a gunshot within the building, the process continues to step 306, which illustrates sound location module 232 determining if the location of the detected gunshot can be determined. As previously discussed, sound location module 232 analyzes the sounds sent by sensors/emitters 102*a*-102*o* to determine the location of the gunshot. Those with skill in the art will appreciate that any type of triangulation software and/or hardware or any other location method may be utilized to perform the location of the gunshot.

If sound location module 232 pinpoints the location of the gunshot, the process continues to steps 312 and 314, which illustrate the release of non-lethal chemical countermeasures at the nearest sensor/emitter location of the gunshot (step 312) and that notification module 234 sends a notice to authorities (e.g., police, security, etc. at server 104) that a gunshot has been detected. If sound location module 232 cannot pinpoint the location of the gunshot, the process continues to steps 308 and 310, which depict the release of non-lethal chemical countermeasures from all sensor emitter locations and notification module 234 sending a notice to authorities (e.g., server 104). Those with skill in the art will appreciate that steps 308 and 310 may occur concurrently or sequentially. Also, steps 312 and 314 may also occur concurrently or sequentially.

The process continues to step 316, which shows notification module 316 determining if the situation has been contained by the authorities. If not, the process returns to step 302 to await detection of another gunshot. If the situation has been contained, the process continues to step 318, which illustrates network 100 resetting for a next emergency. The process returns to step 302 to await detection of another gunshot.

As discussed, the present invention includes a system and method for implementing non-lethal chemical warfare against rampage shooters. A sound detection module detects a sound of a gunshot from at least one of a collection of sensors within a building. A sound location module determines a location of the gunshot by analyzing the sound. At least one emitter releases non-lethal chemical countermeasures from at least one at the location of the gunshot.

It should be understood that at least some aspects of the present invention may alternatively be implemented in a computer-usable medium that contains a program product. Programs defining functions in the present invention can be delivered to a data storage system or a computer system via a variety of signal-bearing media, which include, without limitation, non-writable storage media (e.g., CD-ROM), writable storage media (e.g., hard disk drive, read/write CD-ROM, optical media), system memory such as, but not limited to random access memory (RAM), and communication media, such as computer networks and telephone networks, including Ethernet, the Internet, wireless networks, and like networks. It should be understood, therefore, that such signal-bearing media, when carrying or encoding computer-readable instructions that direct method functions in the present invention, represent alternative embodiments of the present invention. Further, it is understood that the present invention may be implemented by a system having means in the form of hardware, software, or a combination of software and hardware as described herein or their equivalent.

While the present invention has been particularly shown and described with reference to a preferred embodiment, it will be understood by those skilled in the art that various changes in form and detail may be made herein without departing from the spirit and scope of the invention.

What is claimed is:

1. A computer-implementable method for implementing non-lethal chemical warfare against rampage shooters in a building that includes a plurality of sensors and a plurality of emitters, said computer-implementable method comprising:

detecting a sound of a gunshot by at least one of said plurality of sensors within a building;

determining a location of said gunshot by analyzing said sound;

releasing non-lethal chemical countermeasures from at least one of said plurality of emitters at said location of said gunshot.

2. The computer-implementable method according to claim 1, further comprising:

in response to determining that said location of said gunshot cannot be determined, releasing non-lethal chemical countermeasures from all of said plurality of emitters.

3. The computer-implementable method according to claim 1, further comprising:

notifying authorities in response to detecting said sound of said gunshot.

4. A system for implementing non-lethal chemical warfare against rampage shooters in a building, said system comprising:

a plurality of sensors for detecting a sound of a gunshot;

a plurality of emitters for releasing non-lethal chemical countermeasures;

at least one processor;

an interconnect coupled to said at least one processor; and a computer-usable medium embodying computer program code, said computer-usable medium being coupled to said interconnect, said computer program code comprising instructions executable by said at least one processor and configured for:

detecting a sound of a gunshot by at least one of said plurality of sensors within a building;

determining a location of said gunshot by analyzing said sound; and releasing non-lethal chemical countermeasures from at least one of said plurality of emitters at said location of said gunshot.

5. The system according to claim 4, said instructions are further configured for:

in response to determining that said location of said gunshot cannot be determined, releasing non-lethal chemical countermeasures from all of said plurality of emitters.

6. The system according to claim 4, said instructions are further configured for:

notifying authorities in response to detecting said sound of said gunshot.

* * * * *